United States Patent [19]

Morgan

[11] Patent Number: 4,825,820

[45] Date of Patent: May 2, 1989

[54] POWER SYSTEM FOR PISTON ENGINES & COMPRESSION DEVICES

[76] Inventor: George R. Morgan, 1831 S. Berthed Pl., Tucson, Ariz. 85710

[21] Appl. No.: 118,878

[22] Filed: Nov. 9, 1987

[51] Int. Cl.[4] ..... F02B 75/28

[52] U.S. Cl. ..... 123/56 BC; 123/197 AC

[58] Field of Search ..... 123/56 R, 56 AC, 56 BC, 123/58 R, 197 AC

[56] References Cited

U.S. PATENT DOCUMENTS

| | | | |
|---|---|---|---|
| 1,774,105 | 8/1930 | Neldner | 123/56 BC |
| 3,377,997 | 4/1968 | Combs | 123/56 BC |
| 4,013,048 | 3/1977 | Reitz | 123/56 BC |
| 4,485,768 | 12/1984 | Heniges | 123/56 BC |
| 4,598,672 | 7/1986 | Jayne et al. | 123/56 BC |

*Primary Examiner*—Willis R. Wolfe

[57] ABSTRACT

This device is an improvement over the typical power systems of two and four cycle engines, compressors, and external combustion engines. The device replaces the conventional crankshaft and connecting rod with a straight power shaft, power shaft arm, slider block and split scotch yoke. Ball or roller bearings replace conventional type oil bearings. One, two or three cylinders can be placed vertically in a row and closely adjacent to each other with no side thrust being placed on the pistons during operation. The cost of manufacturing and repair should be less than the conventional type engine.

1 Claim, 5 Drawing Sheets

POWER SYSTEM FOR PISTON ENGINES & COMPRESSION DEVICES

The object of this invention is to provide a reliable, simple, low cost and viable power system that is an improvement over the standard or usual crankshaft-connecting rod-piston configuration with related components.

This is achieved by a concept based on the split scotch yoke design. The yoke is attached to the piston and slider block and carries out the function of the connecting rod. The yoke can be made to incorporate one or more pistons, creating a compact and simple design. The yoke also eliminates the side thrust on the piston. The only side force created in the engine is when the slider block moves in the yoke slot under load. This force on the yoke is arrested by the yoke guide sliding in a slot in the yoke. The yoke guide attached to the power shaft housing directs the force on the yoke in shear and not in bending which could possibly make the slider block slot misalign. The yoke is held in linear alignment by the piston and yoke guide. Depending on the stress level and temperature induced by the engine the yoke can be fabricated by casting, moulded or machined from a variety of materials.

The crankshaft is replaced by a straight power shaft and power shaft arm. The crankshaft and connecting rod bearings are also replaced by ball or roller bearings that mount on the straight power shaft. The power shaft can be manufactured from many types of steel or other materials in rod or tubing sized to the engine's specification and fabricated on a low cost machine to ball or roller bearing tolerances.

The power shaft arm is a simple rectangular bar with a hole, key way slot and a pin to mount the slider block and power shaft. Depending on the operating stress level created by the engine a number of off-the-shelf materials can be utilized. The counter balance is attached to the power shaft arm or could be an integral part of the arm. The slider block is a simple rectangular block with a hole and attached to the power shaft arm with a pin.

Carburetion on the two cycle engines as shown in FIG. 2 is achieved by a valve disc attached to the power shaft arm and timed with the carburetor port located in the power shaft housing. A carburetor reed valve or other mechanism can replace the valve disc if desired.

Another object of the invention on two cylinder, two cycle internal combustion engines, see FIGS. 1 and 2, is to conserve fuel. As known, two cycle engines entrap fuel when the exhaust gases are discharged. Not shown in the drawings is a modulating device on the exhaust port which opens/closes with the throttle minimizing fuel loss. This device is timed to let the exhaust gases escape without entraping fuel at various rpms.

Another object of this invention is the versatility of different types of prime movers. FIGS. 1 and 2 show a compact two cylinder, two cycle vertical engine. This engine can be modified into a four cycle engine by eliminating the disc valve and carburetor port and adding regular valves. To replace the simple powershaft and related mechanisms with standard components, two crankshafts and two connecting rods geared to a power shaft are needed.

FIG. 13 of the drawings shows an opposed four cylinder two cycle engine having two yokes attached on each side of one power shaft arm. In this design one power shaft arm is eliminated and the engine is statically balanced without the counter weights. Due to the offset of the opposing cylinders the engine is not dynamically balanced.

An opposed two cylinder two cycle engine, see FIGS. 11, and 12, designed with two power shaft arms and both yokes adjacent to each other is statically balanced and comes very close to being dynamically balanced also.

FIG. 14 is a sketch of a four or eight cylinder, two or four cycle engine. This design can be expanded into an opposed configuration.

FIG. 6 of the drawings shows the piston and yoke of a three stage compressor. The yoke and pistons would have to be modified, but as you can see there are many options utilizing the split scotch yoke.

An opposed two or four cylinder engine, see FIGS. 9 and 10, of the drawings, with the yoke constructed symetrically about the slider block slot, makes a very durable piston yoke unit. This concept can be applied to opposed multicylinder four cycle internal combustion or external combustion engines.

The uniqueness of the invention has many applications in the field of prime movers, compressors, pumps and other related areas.

DETAILED DESCRIPTION

Figure 2:
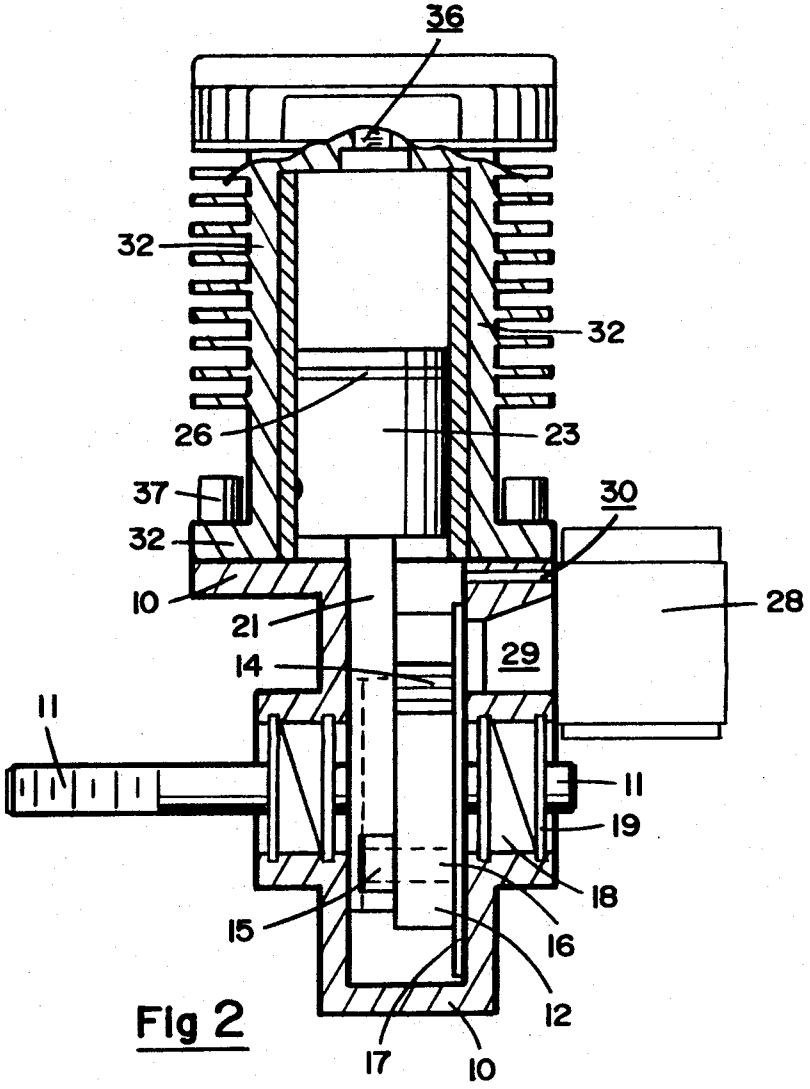
FIG. 2 is a longitudinal sectional view showing the power shaft with related mechanisms and carburetor porting.

The engines described in FIGS. 1 through 14 are the result of the uniqueness of the invention, and to be understood the following detailed descriptions are not to be taken in a limiting sense. Each engine will show the embodiment of the invention in more detail and by reference characters to the drawings.

FIGS. 1 through 5 of the drawings describe a two cylinder, two cycle internal combustion engine. The engine's power shaft 11 is mounted in the power shaft housing 10 by bearings 18 and retainer rings 19. The power shaft arm 12 is attached to the power shaft 11 by the power shaft key 13. This design allows the power shaft arm 12 to float axially on the power shaft 11 in case of mechanical movement under load. The power shaft arm 12 embodies on opposite ends, the counter weight 14 for balancing the engine and the slider block pin 16, which operatively couples the slider block 15 to transmit torque to the power shaft 11. Piston rings 26 are mounted on pistons 23, which are attached to the double piston yoke 21 by wrist pins 27. The downward motion of the double piston yoke 21 is constrained in a linear motion by the yoke guide 39. See FIG. 5.

The carburetor 28 is mounted on the power shaft housing 10 and communicates with the carburetor port 29 and the fuel pump passage 30. Fuel lines, throttle mechanisms and mounting screws are omitted for clarity. The valve disc 17 is attached to the rotating power shaft arm 12 and synchronizes the valve disc opening 47 with the carburetor port 29. See FIG. 1.

Figure 1:
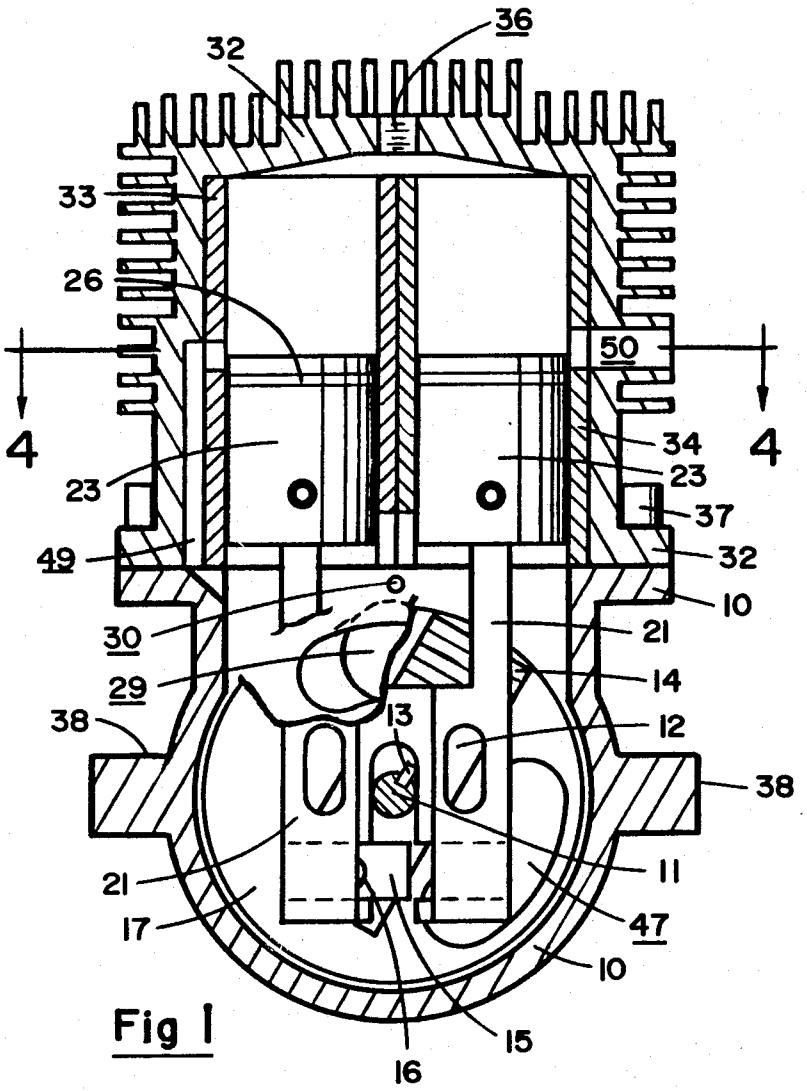
FIG. 1 is a front sectional view of a two cylinder, two cycle engine showing pistons, yoke, power shaft mechanisms and porting. Intake porting in cylinder rotated 90 degrees for clarity.
Figure 3:
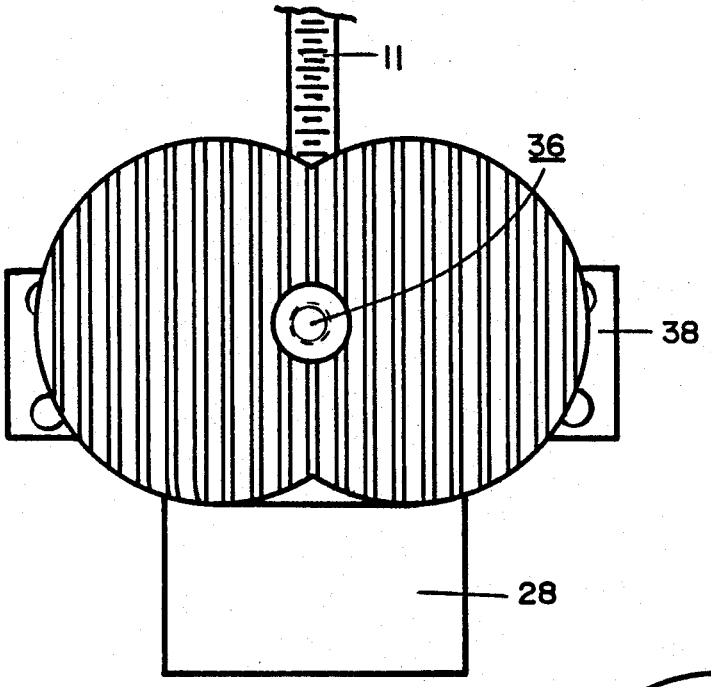
FIG. 3 is a plan view of the cylinders, carburetor and engine mount.
Figure 4:
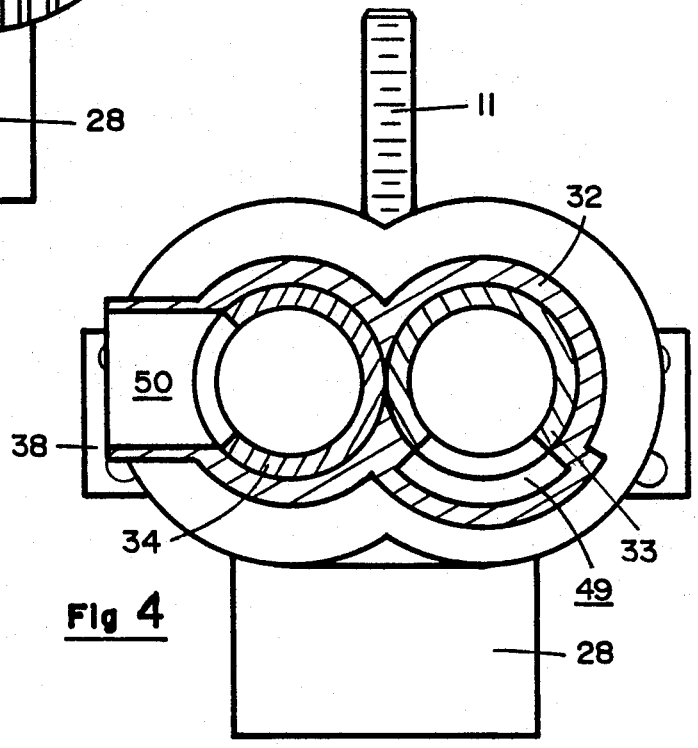
FIG. 4 is a plan sectional view taken along line 4—4 of FIG. 1.
Figure 5:
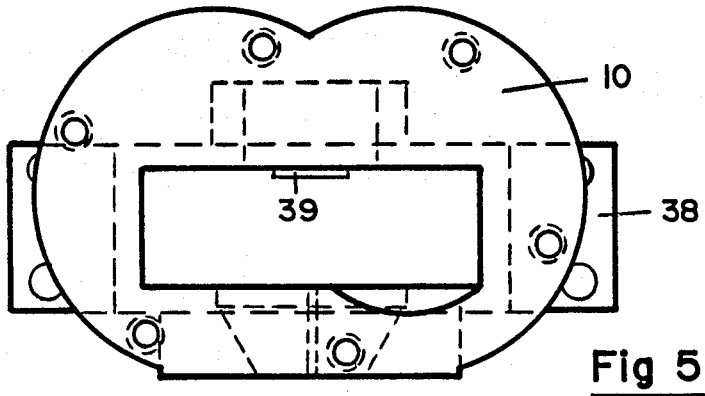
FIG. 5 is a plan view of the power shaft housing and engine mount.

The cylinder housing 32 incorporates the primary cylinder (intake) sleeve 33 with a reciprocating piston 23 therein, the secondary cylinder (exhaust) sleeve 34 with a reciprocating piston 23 therein, the threaded ignition port 36, see FIGS. 1 and 2, and the screws 37 that attaches the cylinder housing 32 to the power shaft housing 10. The engine mount 38 is an integral part of the power shaft housing 10. See FIGS. 1 and 5. FIG. 1 of the drawings shows the actual location of the primary cylinder sleeve 33 and how it communicates with the intake port 49 in the cylinder housing 32 and how the secondary cylinder sleeve 34 communicates with the exhaust port 50 in the cylinder housing 32. FIG. 5 illustrates the attaching threaded hole pattern, engine mount 38 and yoke guide 39.

Figure 6:
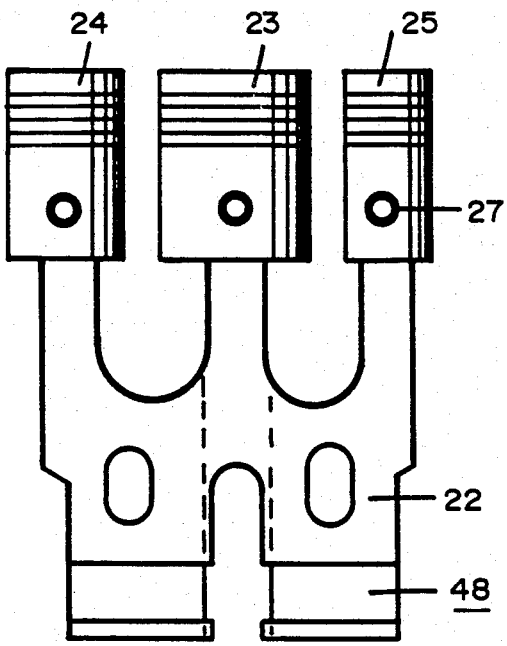
FIG. 6 is a diagrammatic front elevation view of a three piston yoke.
Figure 7:
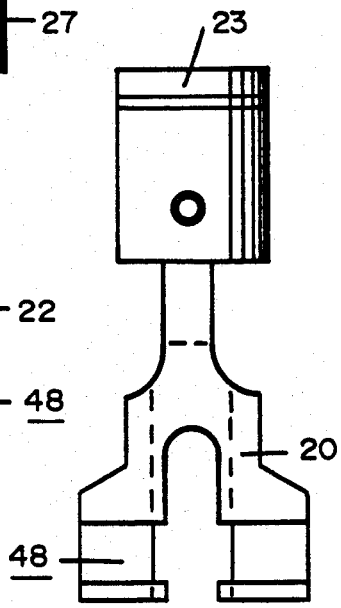
FIG. 7 is a front elevation view of a single piston yoke.
Figure 8:
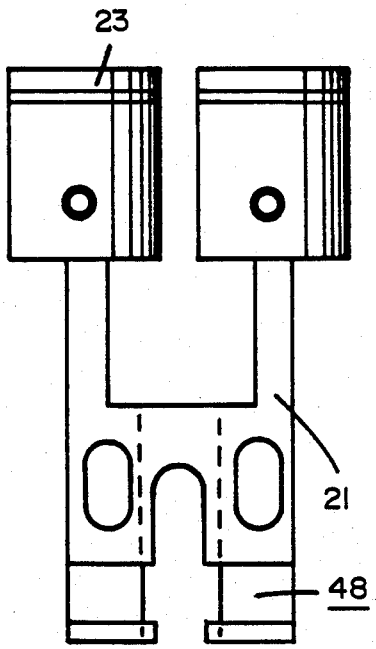
FIG. 8 is a front elevation view of a two piston yoke.
Figure 9:
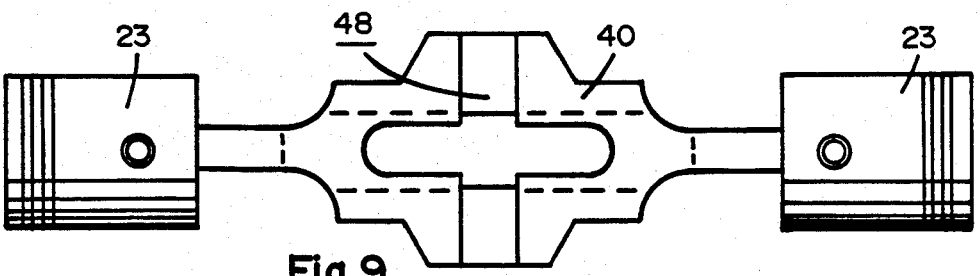
FIG. 9 is a front elevation view of a straight two piston opposed yoke.
Figure 10:
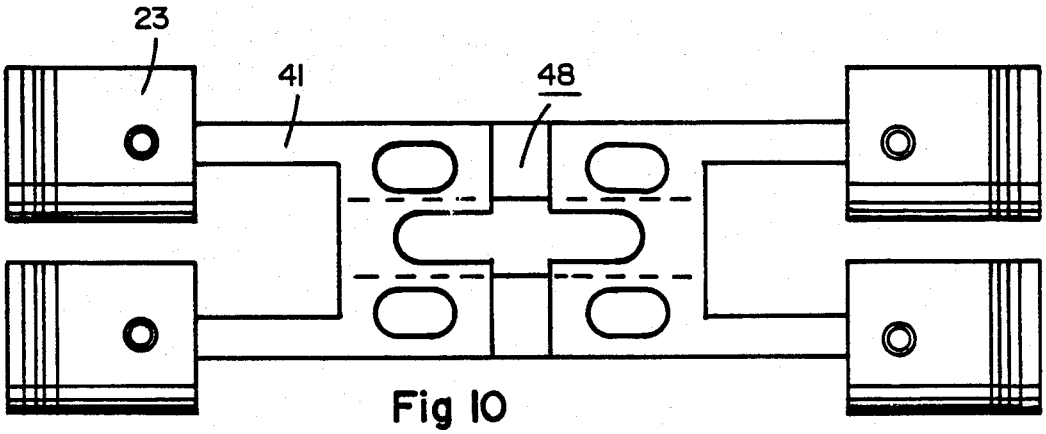
FIG. 10 is a front elevation of a straight four piston opposed yoke.

FIGS. 1 and 6 through 8 more fully illustrate the invention as shown by the double piston yoke 21, FIG. 8, the single piston yoke 20, FIG. 7, and a special three piston yoke 22, FIG. 6, that is attached to a first 23, second 24, and third 25 piston, producing a balanced force on the three piston yoke 22 during a three stage compression. FIG. 9 shows a straight two piston opposed yoke 40 for a four cycle or regenerative type engine. The two piston opposed yoke 40 is basically two single piston yokes 20 joined together using the common slider block slot 48. FIG. 10 shows a straight four piston opposed yoke 41 configuration for a compact four cycle, regenerative or other type prime movers and compressors.

Figure 13:
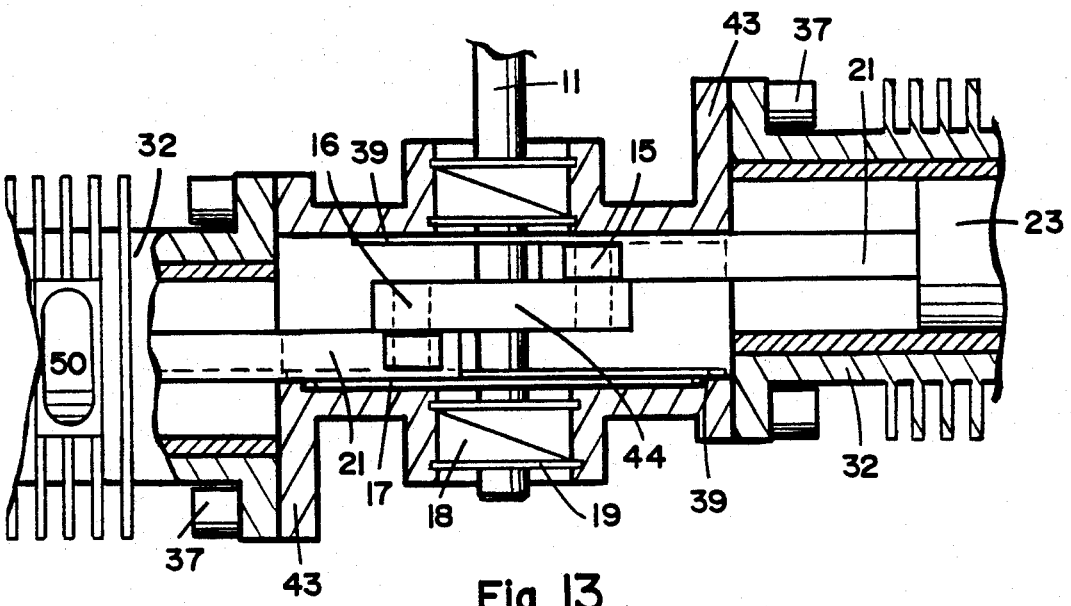
FIG. 13 of a four cylinder opposed two cycle engine showing a double power shaft arm and related components.

FIG. 13 more fully illustrates the viability of the invention by showing a four cylinder opposed two cycle engine comprising a power shaft 11 mounted in the opposed four cylinder power shaft housing 43 by bearings 18 and retainer rings 19. The double power shaft arm 44 comprises a slider block pin 16 and slider block 15 on either end and on opposite sides and is attached to the power shaft 11 by the power shaft key 13. The yoke guides 39 are mounted on the front and rear of the opposed four cylinder power shaft housing 43. A valve disc 17 for carburetion is shown mounted in the rear of the opposed four cylinder power shaft housing 43 and attaches to the power shaft 11 for synchronization. A reed valve can replace the valve disc 17 if preferred. The cylinder housing 32 is attached by screws 37 to the power shaft housing 10.

Figure 11:
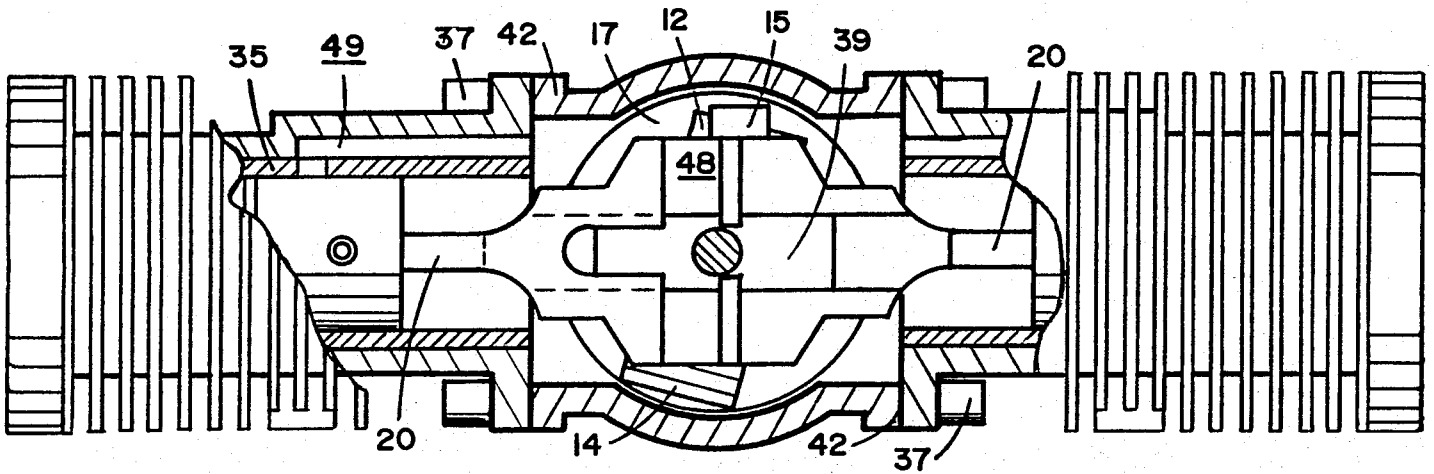
FIG. 11 is a front sectional view of a two cylinder opposed two cycle engine showing mechanisms and related components.
Figure 12:
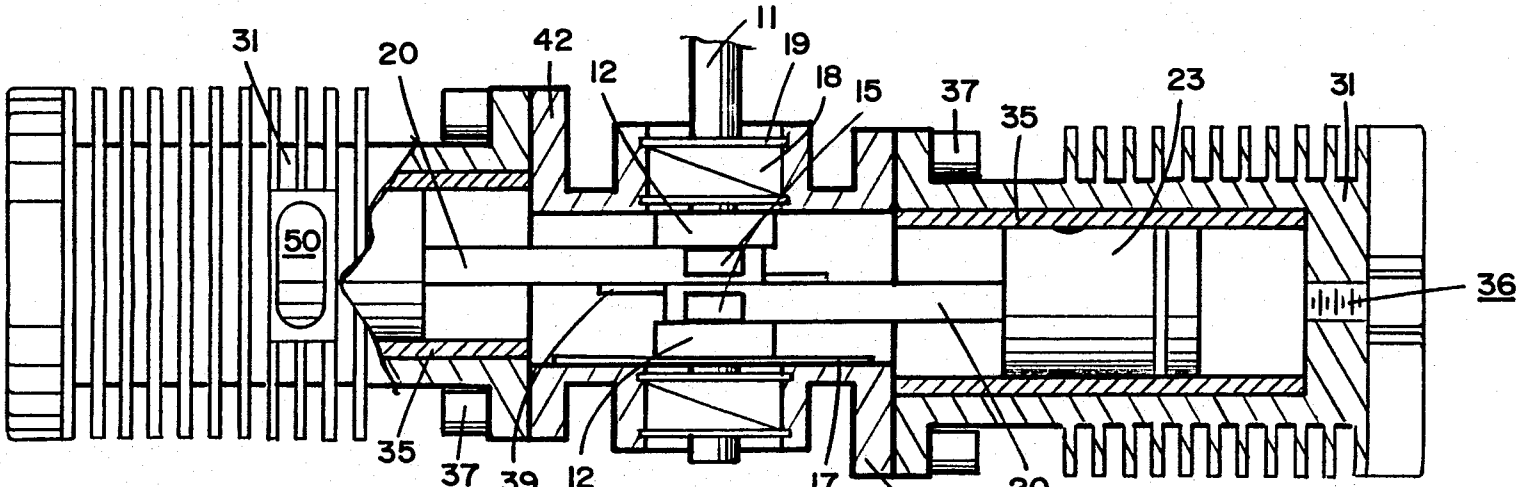
FIG. 12 is a lower sectional view of the FIG. 11 engine showing compact configuration of the single piston yokes.

A two cylinder opposed two cycle engine, see FIGS. 11 and 12, comprise a power shaft 11 mounted in the opposed two cylinder power shaft housing 42 by bearings 18 and retainer rings 19. Two power shaft arms 12 with counter balances 14 incorporate a slider block pin 16 and slider block 15 and is attached to the power shaft 11 by the power shaft key 13. The yoke guide 39 mounts on the power shaft 11 and is located between the single piston yokes 20 in the yoke guide slots 45. The carburetor valve disc 17 is located in the rear of the opposed two cylinder power shaft housing 42 and attaches to the power shaft arm 12 for synchronization. The carburetor 28 is not shown for clarity. The single cylinder housing 31 incorporates a cylinder intake/exhaust sleeve 35 with a reciprocating piston 23 therein, a threaded ignition port 36 and screws 37 that attach the single cylinder housing 31 to the opposed two cylinder power shaft housing 42.

Figure 14:
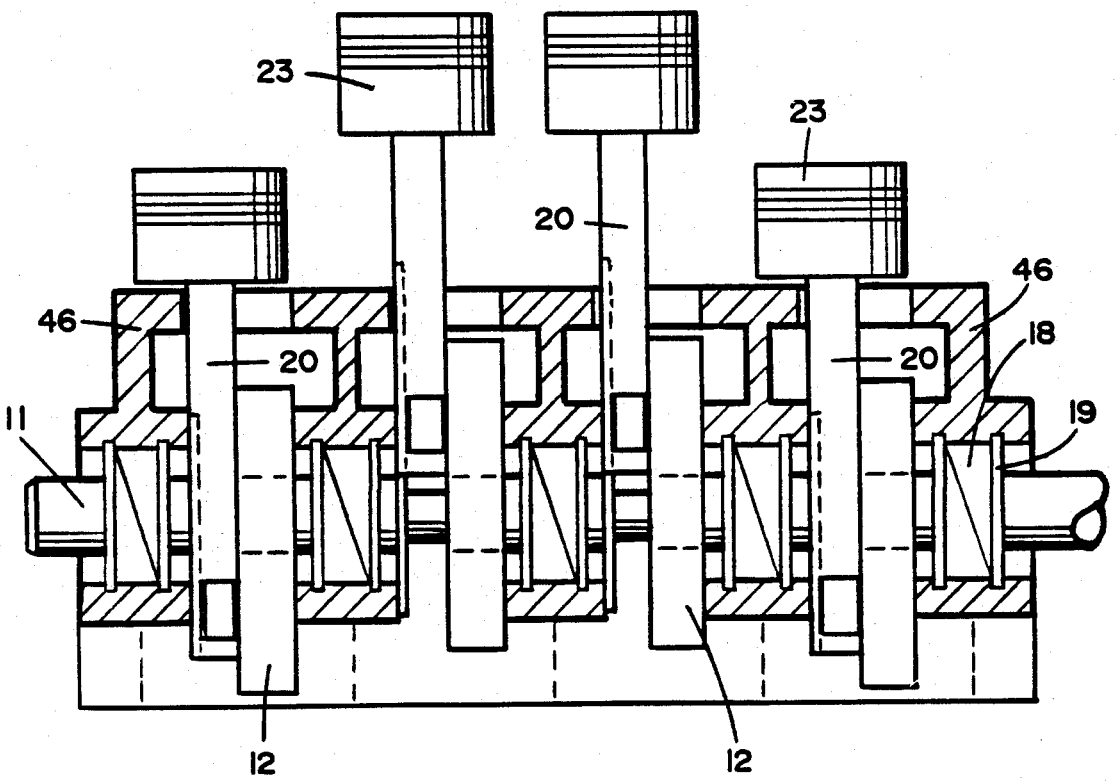
FIG. 14 is a diagrammatic longitudinal view of a four cylinder inline engine showing components.

A four cylinder inline two, four, or regenerative cycle engine, FIG. 14, comprises a power shaft 11 mounted in a four cylinder inline power shaft housing 46 by bearings 18 and retainer rings 19, pistons 23, single piston yoke 20, power shaft arms 12, and other components are the same as those engines outlined in FIGS. 1 through 14.

What is claimed is:

1. In an internal, external combustion engine and compression type devices having reciprocating pistons mounted within cylinders, a rotatable power shaft, means connected to said pistons and power shaft to translate reciprocal motion of said pistons to rotary motion of said power shaft comprising:

a cylinder housing with said reciprocating piston therein, mounted to a power shaft housing with the cylindrical axis located perpendicular to said power shaft axis;

a split scotch yoke attached to said reciprocating pistons located on said cylindrical axis in said power shaft housing oscillating in a fixed relationship with said piston;

a split scotch yoke guide mounted to said power shaft housing located parallel to said cylindrical axis and operatively coupled to said split scotch yoke;

a slider block operatively coupled to said split scotch yoke located in the slider block slot oscillating in a fixed relationship with said split scotch yoke;

a slider block pin operatively coupled and located perpendicular to said slider block oscillating in a fixed relationship with said slider block;

a power shaft arm attached and located perpendicular to said slider block pin rotating in a fixed relationship with said slider block pin;

a power shaft attached and located perpendicular to said power shaft arm rotating in a fixed relationship to said power shaft arm;

a said power shaft housing operatively coupled and located perpendicular to said power shaft;

whereby a reciprocating piston located in said cylindrical housing moves, displacing said split scotch yoke in a linear direction by said split scotch yoke guide, advancing said slider block in said slider block slot, moving said slider block pin attached to said power shaft arm, actuating said power shaft arm operatively coupled to said power shaft, causing said power shaft to rotate;

wherein said reciprocating motion of said piston operatively causes said power shaft to rotate performing work.

* * * * *